US010950972B2

(12) United States Patent
Stevens et al.

(10) Patent No.: US 10,950,972 B2
(45) Date of Patent: Mar. 16, 2021

(54) RESILIENT CABLE CONNECTOR COVER HAVING REGIONS OF SELECTIVE STIFFNESS

(71) Applicant: JOHN MEZZALINGUA ASSOCIATES, LLC, Liverpool, NY (US)

(72) Inventors: Brandon M. Stevens, Liverpool, NY (US); Thomas Sawyer Urtz, Jr., North Syracuse, NY (US); Jeremy Charles Benn, Baldwinsville, NY (US)

(73) Assignee: JOHN MEZZALINGUA ASSOCIATES, LLC, Liverpool, NY (US)

( * ) Notice: Subject to any disclaimer, the term of this patent is extended or adjusted under 35 U.S.C. 154(b) by 51 days.

(21) Appl. No.: 16/372,022

(22) Filed: Apr. 1, 2019

(65) Prior Publication Data

US 2019/0305475 A1 Oct. 3, 2019

Related U.S. Application Data

(60) Provisional application No. 62/651,763, filed on Apr. 3, 2018.

(51) Int. Cl.

| | |
|---|---|
| ***H01R 13/58*** | (2006.01) |
| ***H01R 13/52*** | (2006.01) |
| *H01R 24/40* | (2011.01) |

(52) U.S. Cl.
CPC ..... *H01R 13/5213* (2013.01); *H01R 13/5205* (2013.01); *H01R 13/5804* (2013.01); *H01R 24/40* (2013.01)

(58) Field of Classification Search
CPC ..... H01R 12/00; H01R 13/58; H01R 13/582
USPC ..... 439/523, 449, 419
See application file for complete search history.

(56) References Cited

U.S. PATENT DOCUMENTS 8,764,480 B2 * 7/2014 Natoli ..... H01R 13/5213 439/523

* cited by examiner

*Primary Examiner* — Phuong K Dinh
(74) *Attorney, Agent, or Firm* — Barclay Damon LLP

(57) ABSTRACT

A cable connector cover includes a unitary body configured to receive a connector mounted to a coaxial cable and comprises an interface portion, an intermediate portion and a cable relief portion. The interface portion has a forward inner surface defining a forward space configured to receive and engage an outer surface of an interface component. The interface portion comprises a first resilient material having a first characteristic softness. The intermediate portion has an intermediate inner surface defining an intermediate space configured to receive and engage an outer surface of a connector body. The intermediate space is smaller than the forward space. The cable relief portion has a rearward inner surface defining a rearward space configured to receive and engage the cable portion. The cable relief portion has a second characteristic softness which is stiffer than the first characteristic softness of the interface portion.

18 Claims, 3 Drawing Sheets

RESILIENT CABLE CONNECTOR COVER HAVING REGIONS OF SELECTIVE STIFFNESS

CROSS REFERENCE TO RELATED INVENTION

This application claims the benefit of the filing date and priority of U.S. Provisional Patent Application No. 62/651,763, filed Apr. 3, 2018, entitled "CABLE CONNECTOR COVER". The complete specification of this application is hereby incorporated by reference in its entirety.

BACKGROUND

Technical Field

This disclosure relates to covers for electrical connectors and, more particularly, to a new and useful elastomer cover which provides a more reliable and robust, weather protecting cover for an RF connector.

DESCRIPTION OF THE RELATED ART

Transmission line components such as connectors are often exposed to the open environment and are thus susceptible to degradation from weather related corrosive effects (e.g., moisture infiltration), pollution, debris and other elements. Degradation of the components potentially leads to degradation of the signal quality being transmitted through the cables.

To protect the components environmental effects, layers of tape have been used to cover and seal the components, creating what have conventionally been referred to as tape-wrap seals. The tape layers typically consist of a first layer of electrical tape, followed by a layer of butyl tape, and then followed by another layer of electrical tape. While the layering of tape does in certain instances provide for a secure seal, it is not without its drawbacks.

First, taping requires significant time in its initial installation, and must be removed for servicing of components (and reapplied after servicing is complete). In addition to the cost associated with the application/removal of tape, the seal obtained by taping is heavily dependent on the skill of the operator. Inconsistent application of the tape can lead to ineffective sealing of components.

Second, the properties inherent in the material composition subject the tape to fluctuations in size and inconsistencies associated with adherence. For example, the tape contracts in colder temperatures and loses adherence strength in warmer temperatures. As a consequence, the quality of the seal becomes compromised in regions that experience wide temperature fluctuations. In addition, pollutants and other environmental factors adversely affect the sealing quality of the tape.

In addition to tape as a sealing solution, plastic clamshell or valise type covers have been used to envelop the components of RF connectors. These style covers are exemplified by a plastic material composition and closure mechanisms employed to secure the clamshell components around the connector. While the clamshell style facilitates quicker installation and removal, the plastic material becomes brittle in colder temperatures, which results in reduced ductility over time. As the material becomes more brittle, the closure mechanisms lose their effectiveness often breaking or becoming ineffective for their intended design function.

Therefore, a need exists to overcome, or otherwise lessen the effects of, the disadvantages and shortcomings described above.

SUMMARY

It is therefore an object of the disclosed embodiments to provide a cover for cable connectors or other components that may be quickly installed and/or removed.

It is another object of the disclosed embodiments to provide a cable component cover that protects the cable connectors or other components from the environment.

It is yet another object of the disclosed embodiments to provide a cable component cover that maintains its sealing properties regardless of temperature fluctuations.

It is a further object of the disclosed embodiments to provide a cable connector cover that may be used in conjunction with other cable connector covers of various sizes and/or shapes.

In accordance with the foregoing objects and advantages, in one embodiment, a cable connector cover protects a connector attached to a prepared end of a coaxial cable. The cover includes a unitary body extending along an axis which is configured to receive a connector mounted to a coaxial cable. The unitary body comprises an interface portion, an intermediate portion, and a cable relief portion. The interface portion has a forward inner surface defining a forward space configured to receive and engage an outer surface of an interface component. The interface portion comprises a first resilient material having a first characteristic softness. The intermediate portion has an intermediate inner surface defining an intermediate space configured to receive an outer surface of a connector body. The intermediate space is smaller than the forward space. The cable relief portion has a rearward inner surface defining a rearward space configured to receive and engage the cable portion. The rearward space is smaller than the intermediate space. The cable relief portion has a second characteristic softness which is stiffer than the first characteristic softness of the interface portion.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
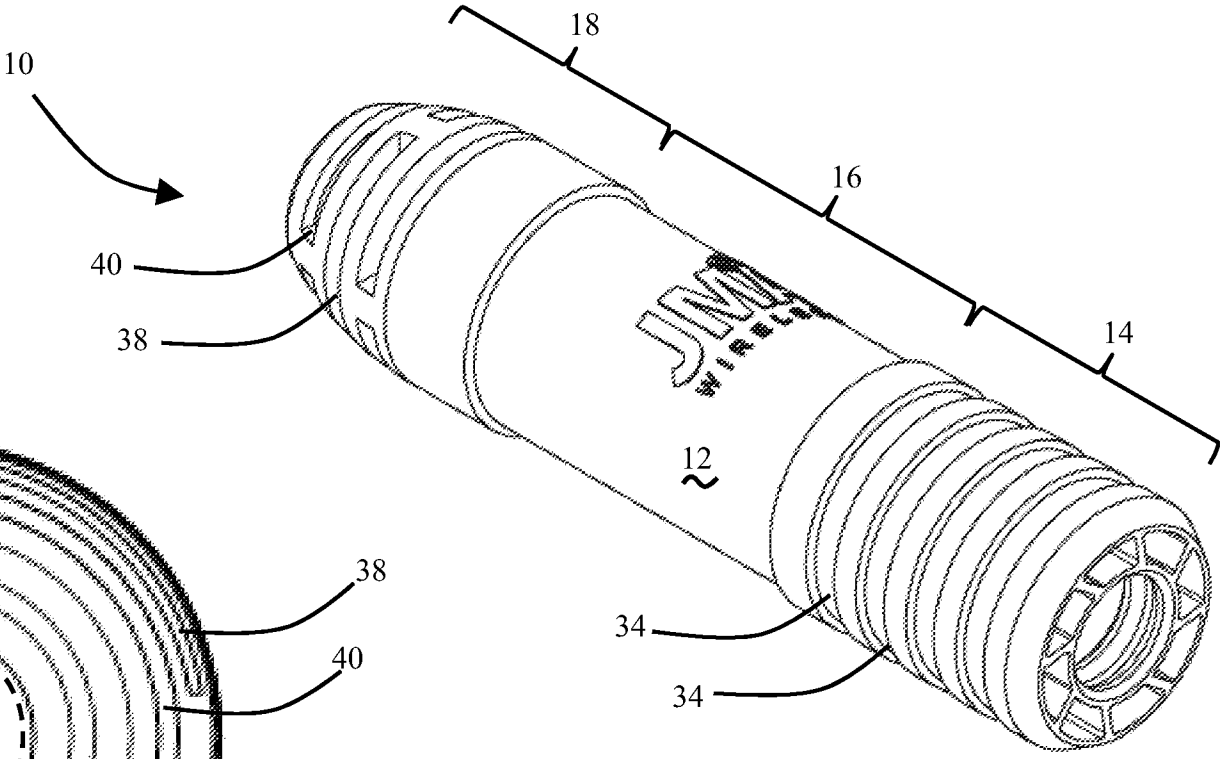
FIG. 1 is an forward perspective view of one embodiment of the cable cover including an interface portion, a cable relief portion and an intermediate connector body portion disposed between the interface and cable relief portions of the cable connector cover.
Figure 3:
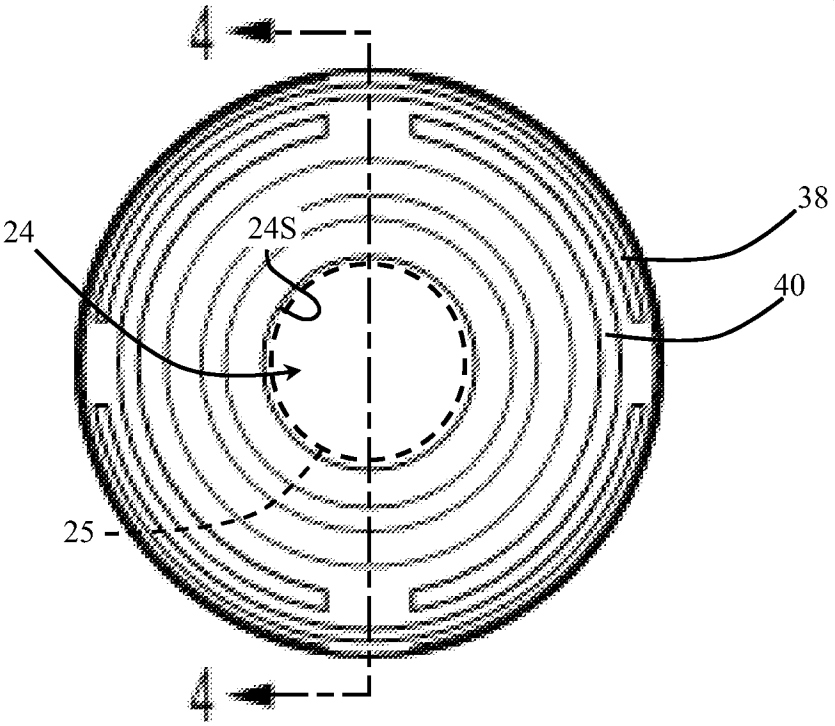
FIG. 3 is an end view of the connector cover facing the cable relief portion thereof.

Referring now to the drawings, wherein like reference numerals refer to like parts throughout, there is seen in FIG.

1 a cable connector cover, designated generally by reference numeral 10, configured to be placed in secure and sealing relation to a connector (not shown) such as a 5-series connector manufactured by John Mezzalingua Associates of East Syracuse, N.Y. The connector may be configured to terminate any one of a variety of coaxial cables having a diameter dimension ranging from about one half inch (0.5") to about one inch (1.0") in diameter dimension. In the embodiment shown in FIGS. 1 and 2, the connector cover 10 comprises an elongate body 12 composed of an resilient or rubber material (e.g., silicone rubber) that exhibits a low modulus of elasticity (i.e., Young's Modulus) over an extended temperature range.

In FIGS. 3-6, the connector cover 10 comprises an interface portion 14, a cable relief portion 18 and an intermediate body portion 16 disposed therebetween. The interface, cable relief and intermediate body portions 14, 18, 16 of the cable connector cover 10 are configured internally to receive/accept a coaxial cable, a connector body and/or an interface port. The various sections or portions which comprise the connector cover 10 produce a unitary body 12 extending along an elongate axis A. More specifically, the interface portion 14 includes a forward inner surface 24S defining a forward space 24 configured to receive and engage an outer surface 25S of an interface port 25. The intermediate portion 16 includes a forward inner surface 26S defining an intermediate space 26 configured to receive and engage an outer surface 27S of a connector 27. And the cable relief portion 18 includes a rearward surface 28S defining a rearward space 28 configured to receive and engage an outer surface 29S of a coaxial cable 29.

In the described embodiment, the rearward space 28 is smaller than the intermediate space 26 and the intermediate space 26 is smaller than the forward space 24. Accordingly, the interface portion 14 corresponding to the forward space 24, which has the largest diameter dimension, may slide over, engage and seal with the interface port 25. The cable relief portion 18 corresponding to the rearward space 28, which has the smallest diameter dimension, may slide over, engage and seal against the outer surface 29S of the coaxial cable 29. The intermediate space 26, which has a diameter dimension between the largest and smallest diameters, may receive the connector body 27. The intermediate space 26 need not engage or seal with the connector body 27 inasmuch as the seals established along the forward and rearward surfaces 24S, 28S prevent moisture and debris from entering the space 26.

The interface portion 14 comprises a first resilient material having a first characteristic softness while the cable relief portion 18 comprises a second resilient material having a second characteristic softness. The intermediate portion 16 may comprise a third resilient material having a third characteristic softness which is essentially the same as the second characteristic softness, however, the third characteristic softness may alternatively have a transitional softness between the softness of the first and second characteristic softness. The softness characteristics of the interface portion is effected by a plurality of spokes 50, described in further detail in subsequent paragraphs and best seen in FIG. 7 of the drawings.

The second characteristic softness of the cable relief portion is stiffer, or harder, than the first characteristic softness of the interface portion. Similarly, the third characteristic softness of the intermediate may be stiffer or harder than the first characteristic softness. In the described embodiment, the resilient material of the interface portion is an elastomer, rubber, silicone rubber, or urethane rubber material having a Shore A hardness of between about 25 A to about 35 A. The resilient material of the intermediate and cable relief portions 16, 18 is also an elastomer, rubber, silicone rubber or urethane rubber material, however, the characteristic softness of each of these portions 16, 18 is harder than the characteristic softness of the interface portion 14. The resilient material of each of these portions 16, 18 has a Shore A hardness of between about 55 A to about 70 A. As mentioned in the preceding paragraph, the Shore A hardness of the intermediate region may effect a softness transition from a Shore A hardness of 25 A or 35 A to a Shore A hardness of 55 A or 70 A. The transition may be stepped transition, a linear transition, or a logarithmic transition. The transition from soft to hard allows the interface portion 14 to be highly elastic and pliable so as to stretch over and around the interface port 25. Such properties are particularly important to allow the end of the interface portion 14 to seal with or against a necked-down region 23 of the interface port 25.

Figure 7:
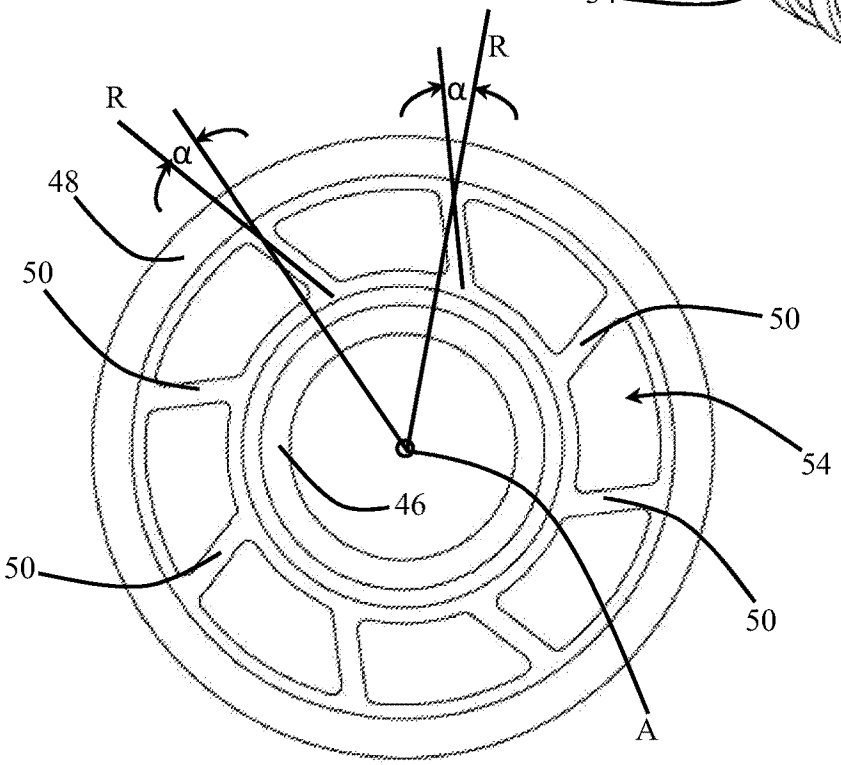
FIG. 7 is a view taken along line 7-7 of FIG. 4 depicting a plurality of non-radial spokes to center an annular ring configured to seal with around an interface port for mounting the cable connector.
Figure 6:
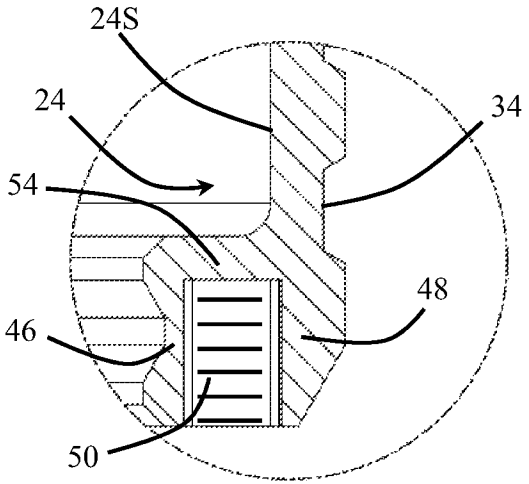
FIG. 6 is an enlarged view of a section of the interface portion of the cable cover identified in FIG. 4.
Figure 4:
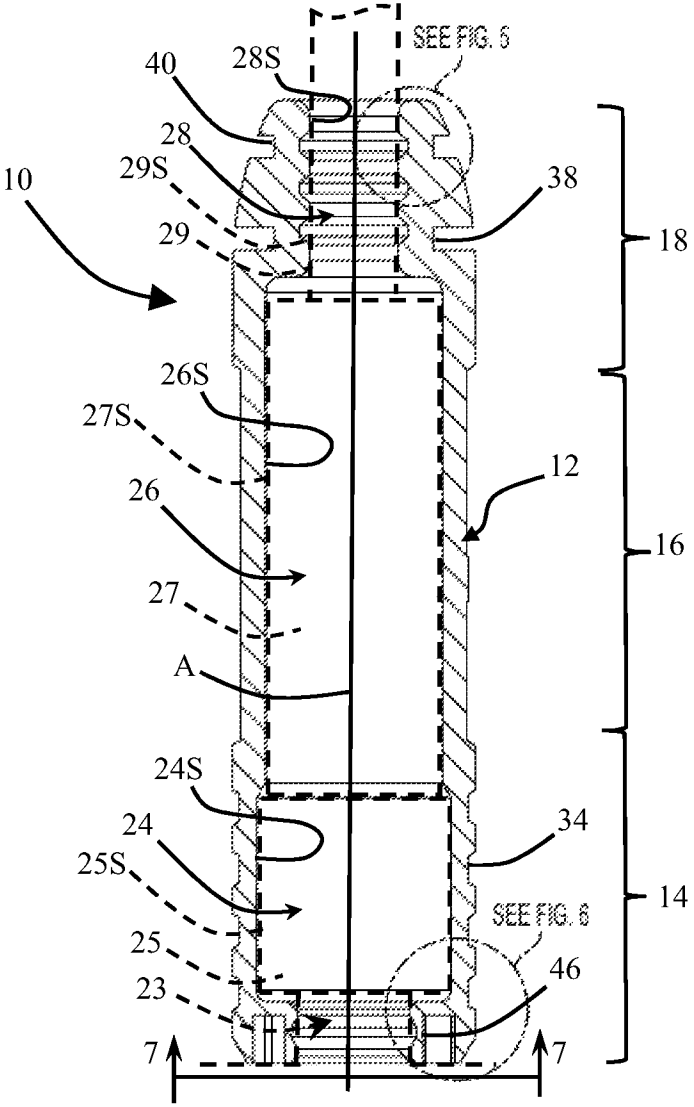
FIG. 4 is a cross-sectional view taken of the cable connector cover taken substantially along line 4-4 of FIG. 3.

In FIGS. 4, 6 and 7, the interface portion 14 defines an inner sleeve 46 and an outer sleeve 48 connected to the inner sleeve 46 by a plurality of resilient spokes 50. In the described embodiment, a total of eight radial spokes 50 project from the inner sleeve 46 and are integrally formed along a resilient wall 54 connecting, and extending between, the inner and outer sleeves 46, 48. The resilient spokes 50 function to radially support the outer sleeve 48 without producing points of radial stiffness, as would be generated by, for example, a plurality of radial spokes. It will be appreciated that radial spokes can produce undulations in the outer sleeve 48 which would adversely impact the cylindrical or circular sealing surface of the outer sleeve 48. The same may occur in connection with the inner sleeve 46, but having a lesser affect inasmuch as the spokes 50 are closer together. The resilient wall 54 is integrated and sealed to each of the spokes 50 such that a seal is produced between the spokes 50 and between the inner and outer sleeves 46, 48. While, in the described embodiment, the resilient wall 54 is disposed over the inboard edge or side, of each spoke 50, it will be appreciated that the resilient wall 54 may be disposed along the outboard edge, or side, of each spoke 50. In this way, the spokes, 50 function to provide the requisite softness, stability and support while producing a seal between the necked-down region 23 of the interface port 25 and the interface portion 14 of the cable connector cover 10. While the disclosed embodiment depicts a total of eight (8) spokes 54, it will be appreciated that a fewer or greater number of spokes may be employed. Each of the resilient spokes 50 define an angle $\alpha$ relative to a radial line R projecting from the elongate axis A. In the described embodiment, the angle $\alpha$ is between about thirty-five degrees (35°) to about fifty-five degrees (55°) relative to the radial line R. Generally, between six (6) and twelve (12) non-radial spokes should be employed to provide the requisite flexibility, pliability, and percent elongation to slide the cover 10 over an external surface of the interface port 25.

Figure 2:
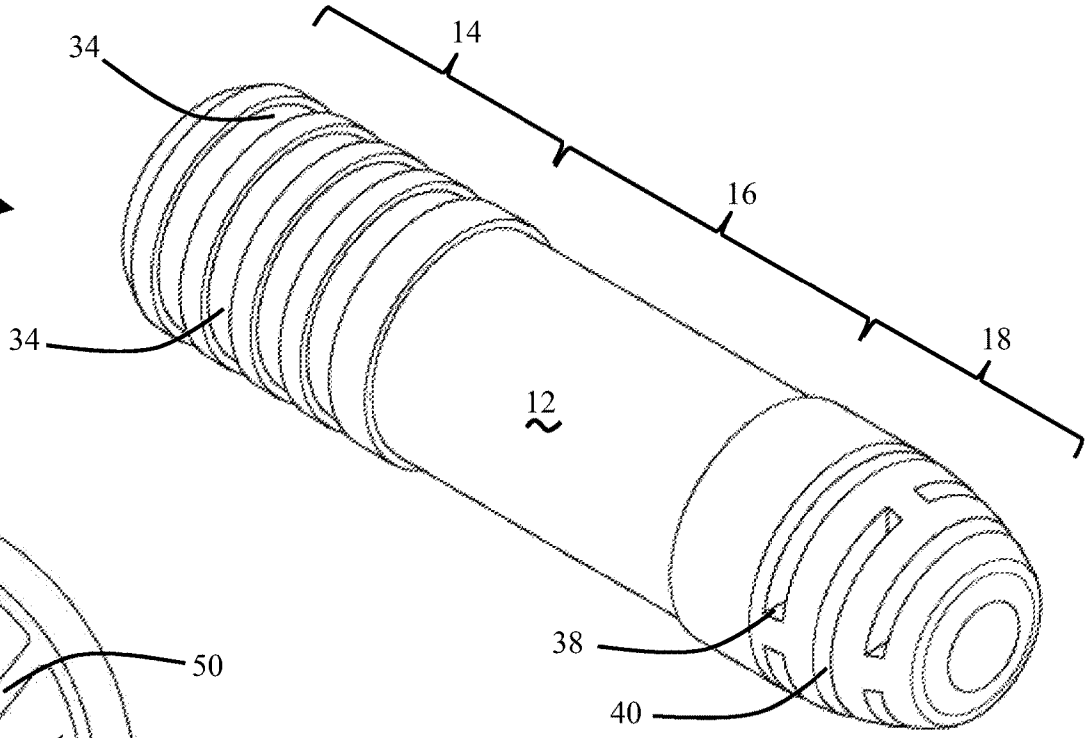
FIG. 2 is an rear perspective view of the cable connector cover shown in FIG. 1.
Figure 5:
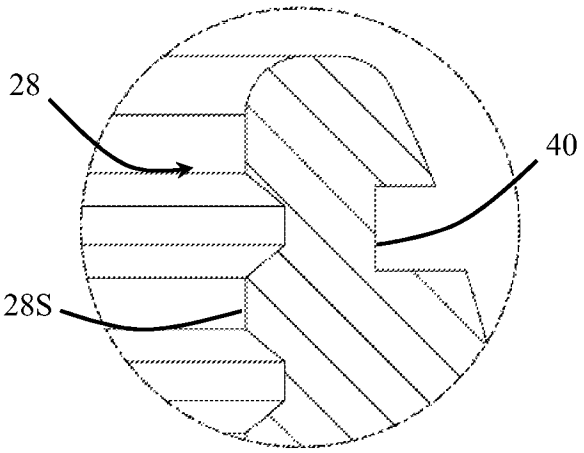
FIG. 5 is an enlarged view of a section of the cable relief portion of the cover identified in FIG. 4.

To facilitate grip, the intermediate portion 16 is reduced in diameter dimension, while the interface portion 14 is ringed with a plurality of external annular grooves 34, (see FIGS. 1, 2, and 5). To facilitate flexibility, the cable strain relief portion 18 includes a plurality of arcuate grooves 38, 40 each having an arc-length less than three-hundred and sixty degrees (360°), and, in the described embodiment, are each less than about one-hundred and eighty (180°) degrees. Although it should be noted that a strain relief groove 38, 40 may be suitable in a particular application and a groove could extend entirely around the circumference. Internally, the cable strain relief 18 defines a plurality of annular rings for sealing with the outer jacket of the coaxial cable. Alternatively, the cable strain relief may define an interference fit with the outer jacket to form a watertight seal.

Use of the connector cover 10 involves sliding the cable relief end 18 over the coaxial cable (not shown) that is to be terminated in a connector, leaving the terminal end of the cable exposed. As the cover 10 is designed to have an interference fit with the cable, it may be useful to apply a small amount of grease to the outside of the cable jacket to assist in pulling the cover over the cable (although the preferred pre-lubricated rubber composition of cover may make such step unnecessary). The cable may then be terminated and attached to a connector in a conventional manner. The connector cover 10 is then manually slid over connector until its cable relief end 18 abuts an end of the connector.

The connector may then be attached to the interface port 25 in a conventional manner. This will typically involve threading a female sleeve of the interface port 25 with male threads of the connector body 27. The interface portion 14 of the connector cover 10 is then stretched over interface port 25 such that the inner sleeve 46 engages and seals with the neck 23 of the interface port 40. Although the present invention has been described in connection with a preferred embodiment, it should be understood that modifications, alterations, and additions can be made to the invention without departing from the scope of the invention as defined by the claims.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The invention claimed is:

1. A cable connector cover comprising:

a unitary body extending along an axis, the unitary body configured to receive a coaxial cable and a connector mounting to the coaxial cable, the unitary body comprising:

an interface portion having a forward inner surface defining a forward space, the forward space configured to receive and engage an outer surface of an interface component, the interface portion comprising a first resilient material having a first characteristic softness;

an intermediate portion having an intermediate inner surface defining an intermediate space, the intermediate space being smaller than the forward space and configured to receive an outer surface of a connector body; and a cable relief portion having a rearward inner surface defining a rearward space, the rearward space being smaller than the intermediate space and configured to receive and engage the cable portion, the cable relief portion having a second characteristic softness which is stiffer than the first characteristic softness of the interface portion, wherein the interface portion defines an outer sleeve and an inner sleeve connected to the outer sleeve by a plurality of resilient spokes.

2. The cable connector cover of claim 1 wherein the intermediate portion has a third characteristic softness wherein the third characteristic softness is stiffer than the first characteristic softness.

3. The cable connector cover of claim 1 wherein each of the second and third characteristic softness is stiffer than the first characteristic softness.

4. The cable connector cover of claim 1 wherein the first characteristic softness has a Shore A hardness of between about 25 A to about 35 A.

5. The cable connector cover of claim 1 wherein the second characteristic softness has a Shore A hardness of between about 55 A to about 75 A.

6. The cable connector cover of claim 1 wherein the third characteristic softness has a Shore A hardness of between about 55 A to about 75 A.

7. The cable connector cover of claim 1, wherein each of the plurality of resilient spokes defines an angle $\alpha$ relative to a radial line projecting from the elongate axis.

8. The cable connector cover of claim 7, wherein the angle $\alpha$ is between about thirty-five degrees (35°) to about fifty-five degrees (55°) relative to the radial line.

9. The cable connector cover of claim 7 wherein the intermediate portion has a third characteristic softness wherein the third characteristic softness is harder than the first characteristic softness.

10. The cable connector cover of claim 7 wherein each of the second and third characteristic softness is stiffer than the first characteristic softness.

11. The cable connector cover of claim 7 wherein the first characteristic softness has a Shore A hardness of between about 25 A to about 35 A.

12. The cable connector cover of claim 7 wherein the second characteristic softness has a Shore A hardness of between about 55 A to about 75 A.

13. The cable connector cover of claim 7 wherein the third characteristic softness has a Shore A hardness of between about 55 A to about 75 A.

14. The cable connector cover of claim 11 wherein each of the second and third characteristic softness has a Shore A hardness of between about 55 A to about 75 A.

15. The cable connector cover of claim 14 wherein an outer surface of the interface portion includes a plurality of annular grooves.

16. The cable connector cover of claim 15 wherein the outer surface of the cable relief portion includes a plurality of semicircular arcuate grooves.

17. The cable connector cover of claim 16 wherein the semi-circular arcuate grooves are staggered from one groove to an adjacent groove in an axial direction along the outer surface of the cable relief portion.

18. The cable connector cover of claim 14 cable relief portion forms an interference fit with the outer jacket of the cable to produce a watertight seal.

* * * * *